US005555830A

United States Patent [19]

Akiyama

[11] Patent Number: 5,555,830

[45] Date of Patent: Sep. 17, 1996

[54] ROTARY THREAD TAKE-UP LEVER IN A SEWING MACHINE

[75] Inventor: Tatsuhito Akiyama, Tokyo, Japan

[73] Assignee: Juki Corporation, Tokyo, Japan

[21] Appl. No.: 568,418

[22] Filed: Dec. 6, 1995

[30] Foreign Application Priority Data

Dec. 6, 1994 [JP] Japan ..... 6-302433

[51] Int. Cl.[6] ..... D05B 49/04

[52] U.S. Cl. ..... 112/248

[58] Field of Search ..... 112/241, 248, 112/242, 246, 247, 245

[56] References Cited

U.S. PATENT DOCUMENTS

| | | | |
|---|---|---|---|
| 739,158 | 9/1903 | Deihl et al. | 112/248 |
| 2,636,464 | 4/1953 | Van Wagener et al. | 112/248 |
| 2,968,268 | 1/1961 | Meloy, Jr. et al. | 112/248 |

FOREIGN PATENT DOCUMENTS

| | | | |
|---|---|---|---|
| 243786 | 3/1963 | Australia | 112/248 |

*Primary Examiner*—Ismael Izaguirre
*Attorney, Agent, or Firm*—Morgan, Lewis and Bockius LLP

[57] ABSTRACT

A rotary thread take-up lever for acting on an upper thread in a sewing machine, comprising: a base portion which is continuously rotatable around a predetermined axis in one direction; and an arm extending outwardly from the base portion with respect to the axis, the arm including a front edge facing in the direction of rotation of the thread take-up lever and a rear edge facing in the direction opposite to the direction of rotation of the thread take-up lever. The front edge has a thread holding point, wherein the upper thread being lifted by the thread take-up lever is slid on the front edge. The rear edge has a thread holding point, wherein the upper thread being supplied from the thread take-up lever is slid on the rear edge. When the upper thread is supplied maximumly, the upper thread is held by the thread holding points of the front and rear edges, respectively. The radius of rotation of the thread holding point on the rear edge is smaller than the radius of rotation of the thread holding point on the front edge.

3 Claims, 7 Drawing Sheets

ROTARY THREAD TAKE-UP LEVER IN A SEWING MACHINE

BACKGROUND OF THE INVENTION

1. Field of the invention

This invention relates to a rotary thread take-up lever in a sewing machine.

2. Description of the Related Art

In a sewing machine, its rotary thread take-up lever performs a series of operations as follows: That is, the rotary thread take-up lever supplies the upper thread to the needle which is supplied from the bobbin, and then loosens the thread as much as required for the shuttle race body to scoop up the needle and for the thread to pass through the rotary hook. Furthermore, the rotary thread take-up lever pulls up the upper threaded immediately when the thread passes through the rotary hook, and supplies the upper thread which is used for formation of a seam in synchronization with the feeding of the work, and pulls up the upper thread, and tightens the thread. In the description, the term "shuttle" includes the shuttle race body and the rotary hook rotatable inside the shuttle race body.

The rotary thread take-up lever, which is a kind of thread take-up lever, performs the above-described series of upper thread supplying and lifting operations with the aid of the continuous rotation of a thread take-up lever element (described later).

A conventional ordinary rotary thread take-up lever is as shown in FIGS. 6(*a*) and 6(*b*). That is, the conventional rotary thread take-up lever 20 includes a rotary thread take-up lever element 24 which has a base portion 22 and an arm 23 extending from the base portion 22. More specifically, the base portion 22 is fixedly secured to a rotating member 21 which is turned in one direction around a horizontal axis in association with a spindle of the sewing machine such as a needle bar driving crank shaft. The arm 23 extends outwardly from the base portion 22 with respect to the rotating axis.

The rotary thread take-up lever 20 is turned clockwise. When the upper thread forms a single thread loop around the arm 23 of the rotary thread take-up lever (cf. FIGS. 8 and 9), the thread loop is slidably moved back and forth along the front and rear edges 26 and 25 of the arm 23 during the rotation of the thread take-up lever element 24, thus achieving the above-described series of operations of the rotary thread take-up lever. In order to prevent the thread loop from coming off the arm during the rotation of the thread take-up lever element 24, the arm 23 has locking fingers 27 and 28 at its free end while the base end 22 has protrusions 29 and 30 at both sides.

FIG. 7 is a graphical representation indicating a thread take-up lever's motion curve A and a shuttle's motion curve B of an industrial zigzag sewing machine having the above-described conventional rotary thread take-up lever 20 and a full-turn shuttle. In FIG. 7, the horizontal axis indicates the angles of rotation of the arm shaft of the sewing machine, and the vertical axis indicates the lengths of the upper thread supplied by the rotary thread take-up lever. In the vertical axis, the mark "0" corresponds to the position of the throat plate's upper surface. The rotary thread take-up lever's motion curve A is to indicate the lengths of the upper thread supplied by the rotary thread take-up lever, while the shuttle's motion curve B is to indicate the lengths of the upper thread taken up by the shuttle. The lengths of the upper thread thus taken up are based on a thread take-up lever motion scale. The needle bar is located at the highest position (the top dead point) in its range of movement when the angle of rotation of the spindle is 0° and it is located at the lowest position (the bottom dead point) when 180°.

For a period of time between the time instant f and the time instant a in FIG. 7, the upper thread is supplied while sliding on the gently curved portion (indicated by the dotted line 31 in FIG. 6) of the rear edge 25 of the arm 23. FIG. 8 shows the state of the rotary thread take-up lever 20 and the upper thread 16 at the time instant a. The upper thread 16 is held by one point on the rear edge 25 until the time instant a. The upper thread 16 is suitably tensioned by a pair of thread guides (not shown) which are provided respectively on the seam side and on the thread supplying source side.

When the rotary thread take-up lever 20 is further turned, at the time instant a' in FIG. 7, the upper thread 16 is locked by the above-described locking fingers 27 and 28, and it is supplied until the time instant b (in FIG. 7) while being supported by two thread holding points 32 and 33 on the rear edge 25. FIG. 9 shows the state of the thread take-up lever 20 and the upper thread 16 at the time instant b (in FIG. 7). As the thread take-up lever 20 is further turned, the upper thread 16 is pulled upwardly.

The conventional rotary thread take-up lever 20 thus designed suffers from the following problems:

The length M of the thread supplied by the thread take-up lever is much larger than the maximum length m of the thread which is taken up by the shuttle, and therefore the maximum length D of the waste thread is also excessively large. In addition, while the shuttle pulls in the thread, the latter is abruptly released (F in FIG. 7). Hence, in the case where the sewing machine is operated at high speed, the thread is liable to move unstably, as a result of which the resultant seams are irregular, and the thread may be broken.

The maximum length D of the waste thread may be decreased by reducing the distance between the center of rotation O of the rotary thread take-up lever 20 and the thread holding points 32 and 33; i.e., the radius of rotation R1 of the thread holding points 32 and 33. However, in this case, the thread take-up lever's motion curve A corresponding as shown in FIG. 7 is shifted, as a whole, to the left with respect to the shuttle's motion curve B, and the length E of the waste thread which is required for the upper thread 16 to come out of the shuttle is also decreased. Hence, it is not practical to reduce the radius of rotation R1 of the thread holding points 32.

SUMMARY OF THE INVENTION

Accordingly, an object of the invention is to eliminate the above-described difficulties accompanying a conventional rotary thread take-up lever.

More specifically, an object of the invention is to provide a rotary thread take-up lever for a sewing machine with which, while the length of the waste thread which is necessary for the upper thread to come out of the shuttle is maintained, the maximum length of the thread supplied by the rotary thread take-up lever is reduced thereby to prevent the formation of irregular seams, and the breakage of the thread.

The foregoing object of the invention has been achieved by the provision of a rotary thread take-up lever for acting on an upper thread in a sewing machine, comprising: a base portion which is continuously rotatable around a predetermined axis in one direction; and an arm extending outwardly from the base portion with respect to the axis, the arm including a front edge facing in the direction of rotation of the thread take-up lever and a rear edge facing in the direction opposite to the direction of rotation of the thread take-up lever. The front edge has a thread holding point, wherein the upper thread being lifted by the thread take-up lever is slid on the front edge. The rear edge has a thread holding point, wherein the upper thread being supplied from the thread take-up lever is slid on the rear edge. When the upper thread is supplied maximumly, the upper thread is held by the thread holding points of the front and rear edges, respectively. The radius of rotation of the thread holding point on the rear edge is smaller than the radius of rotation of the thread holding point on the front edge.

Briefly stated, the rotary thread take-up lever of the invention functions as follows:

As the rotary thread take-up lever is turned, the upper thread is slidably supplied while being supported at one point on the rear edge of the arm, and further supplied while being supported by the two thread holding points on the front and rear edges of the arm, thus being maximumly supplied. After being maximumly supplied, the upper thread is slidably pulled upwardly while being supported at one point on the front edge of the arm.

Of the two thread holding points of the front and rear edges of the arm which, when the upper thread is supplied maximumly, support the upper thread, the thread holding point of the rear edge which does not concern the operation of pulling the upper thread upwardly after the upper thread has been supplied maximumly, is made smaller in the radius of rotation than the thread holding point of the front edge. Hence, while the length (E in FIG. 7) of the waste thread which is required for the upper thread to come out of the shuttle is maintained, the maximum length (M in FIG. 7) of the thread supplied by the thread take-up lever can be decreased.

DETAILED DESCRIPTION OF THE INVENTION

A rotary thread take-up lever for a sewing machine according to the invention will be described with reference to the accompanying drawings.

Figure 1A:
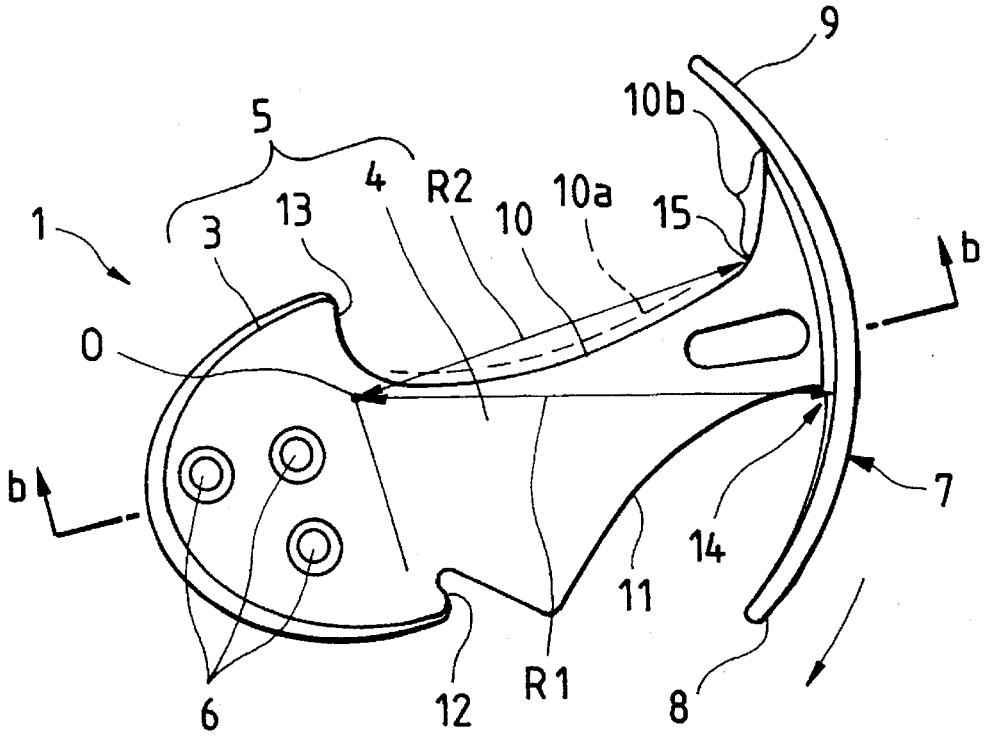
FIG. 1(*a*) is a plan view showing a rotary thread take-up lever in a sewing machine according to the invention, and FIG. 1(*b*) is a sectional view taken along line b—b in FIG. 1(*a*)
Figure 1B:
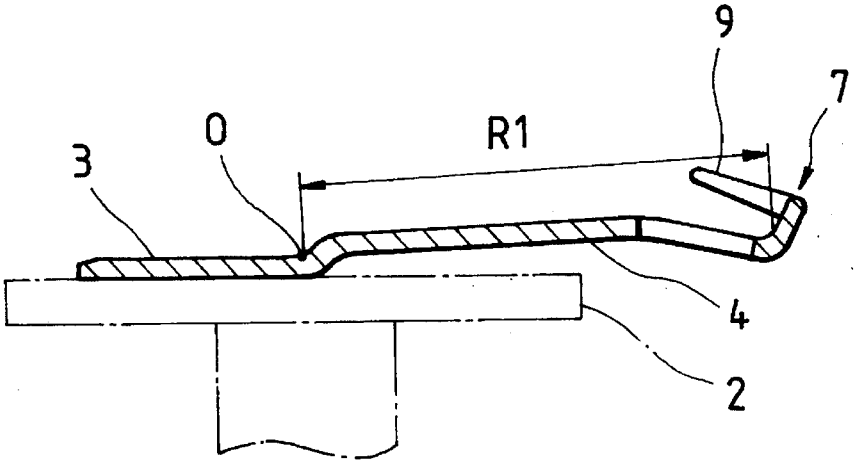

The rotary thread take-up lever according to the invention is generally indicated at 1 in FIG. 1(*a*). The rotary thread take-up lever 1, as shown in FIG. 1(*a*), includes a rotary thread take-up lever element 5 which is made up of a base portion 3, and an arm 4 extending from the base portion 3. More specifically, the base portion 3 is fixedly secured to a rotating member 2 which is turned in one direction around a horizontal axis in association with the spindle of the sewing machine such as a needle bar driving crank shaft, and the arm 4 extends outwardly from the base portion 3 with respect to the rotating axis.

The base portion 3 of the thread take-up lever element 5 is flat and substantially semi-circular, and has three threaded-holes which are used for fixedly securing the thread take-up lever element 5 to the rotating member 2. The arm 4 is extended from the chord of the semi-circle of the base portion. As shown in FIG. 1(*b*), with the base portion 3 fixedly mounted on the rotating member 2, the arm 4 are shifted outwardly in the direction of axis of the rotating member 2 while forming a clearance with the latter 2. The outer end portion of the arm 4 is bent slightly inwardly, and then greatly outwardly, thus being formed into a thread holding portion 7. The thread holding portion 7 includes arcuate locking fingers 8 and 9 which extends forwardly and reversely (in the opposite directions) from the free end of the arm 4 as viewed in the direction of rotation of the thread take-up lever.

Figure 3:
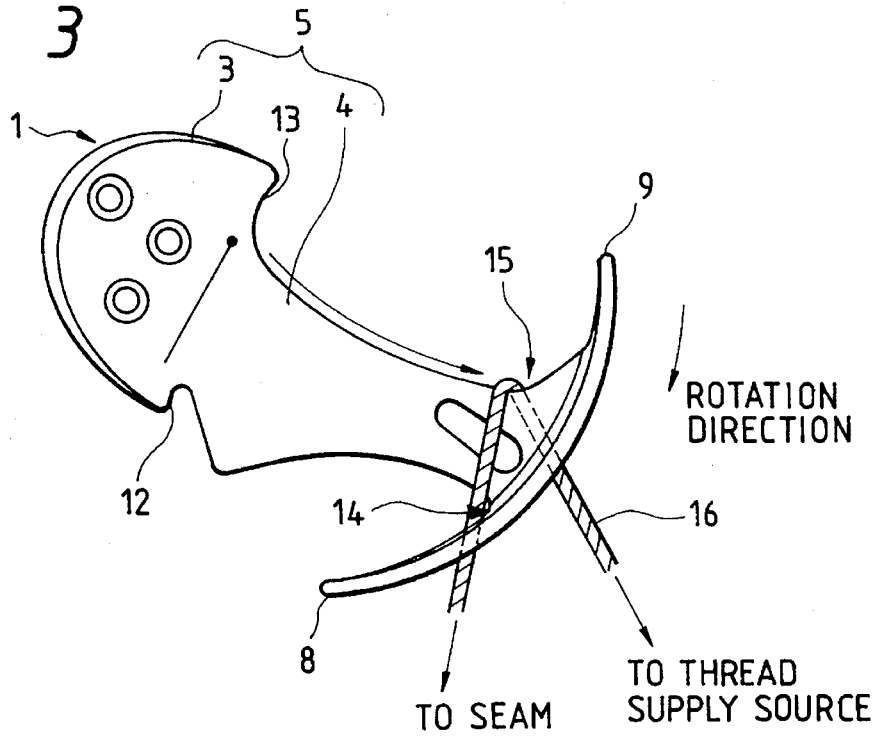
FIG. 3 is a diagram showing the states of the rotary thread take-up lever and the upper thread at the time instant a in FIG. 2.
Figure 4:
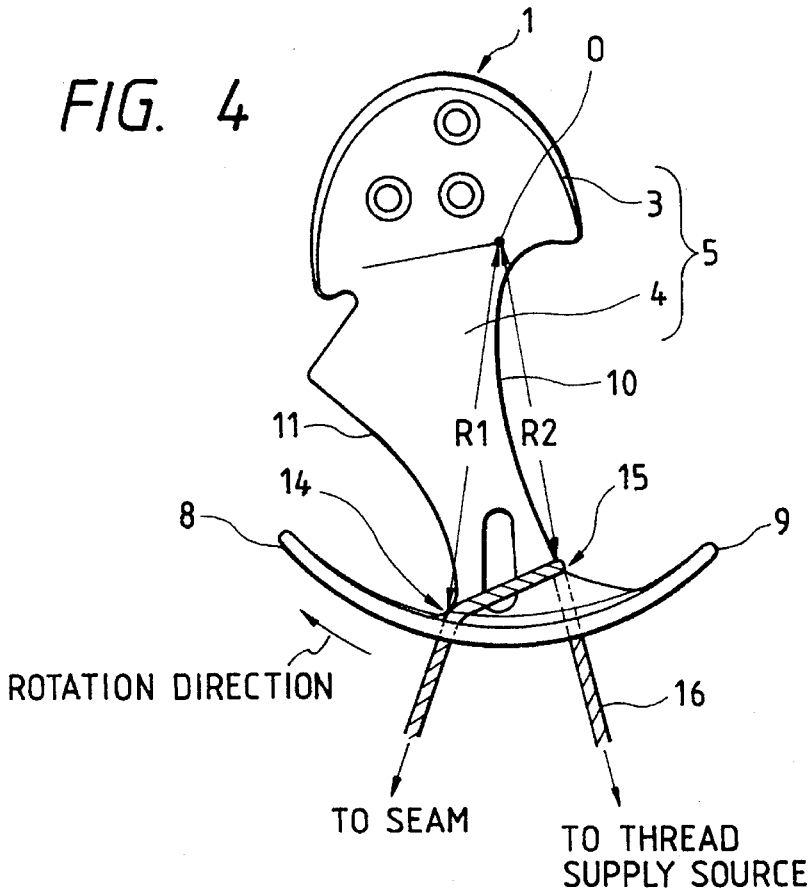
FIG. 4 is a diagram showing the states of the rotary thread take-up lever and the upper thread at the time instant b in FIG. 2.
Figure 5:
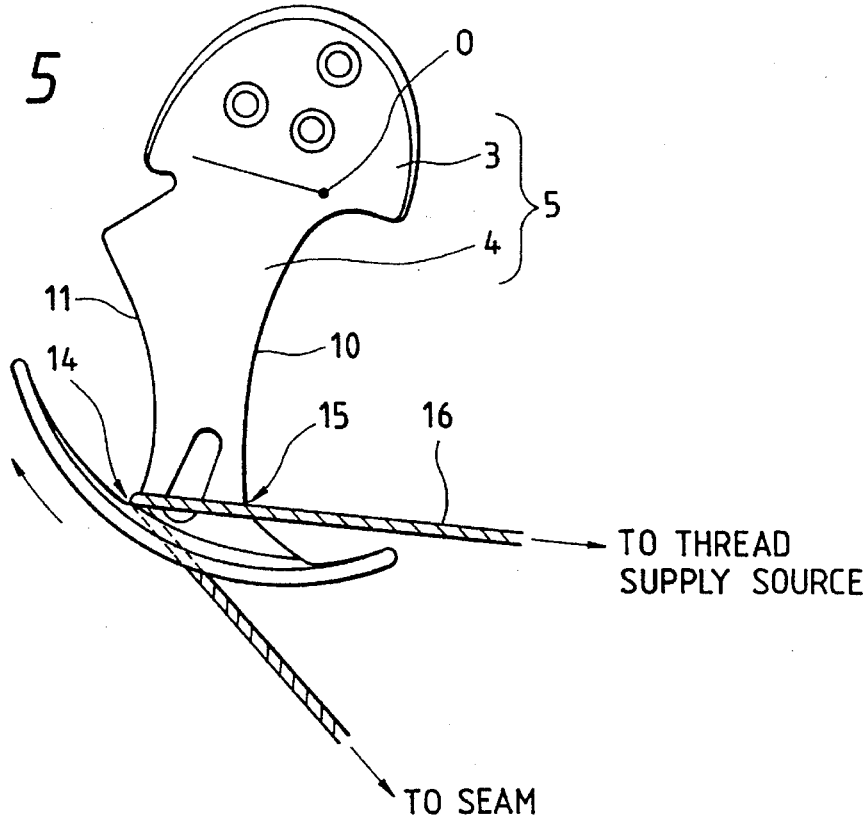
FIG. 5 is a diagram showing the states of the rotary thread take-up lever and the upper thread at the time instant c in FIG. 2.
Figure 6A:
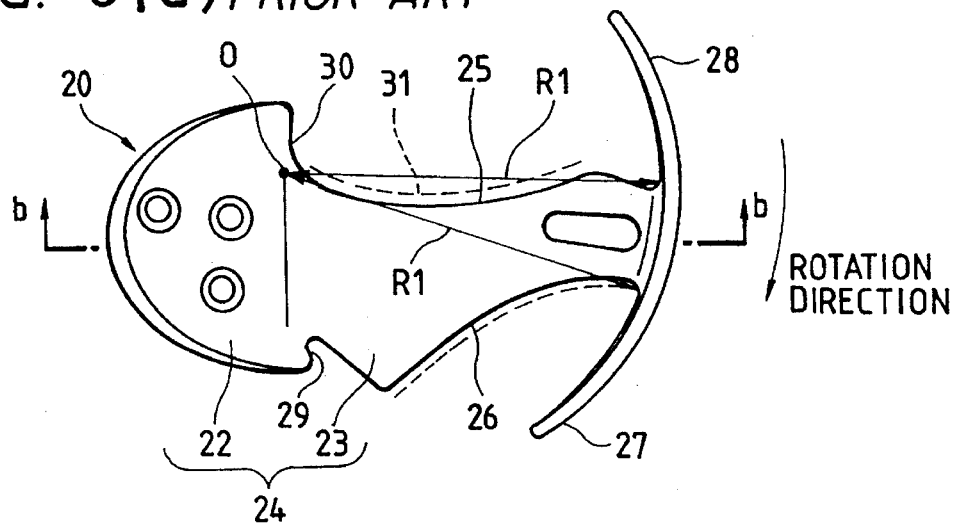
FIG. 6(a) PRIOR ART
FIG. 6(*a*) is a plan view showing a conventional rotary thread take-up lever, and FIG. 6(*b*) is a sectional view taken along line b—b in FIG. 6(*a*)
Figure 6B:
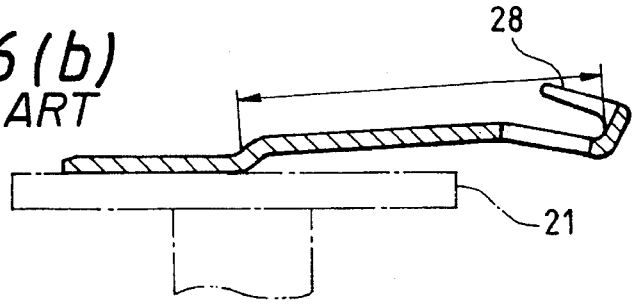
FIG. 6(b) PRIOR ART

The rotary thread take-up lever 1 is turned clockwise. Under the condition that the upper thread forms a single thread loop around the arm 4 of the thread take-up lever 1 (as shown in FIGS. 3 through 5), a thread take-up operation is carried out; that is, the thread loop thus formed is slid back and forth along the rear and front edges 10 and 11 of the arm to take up the thread. During the rotation of the rotary thread take-up lever 1, the thread loop is prevented from falling down the arm by the locking fingers 8 and 9 formed at the free end of the arm 4 and by protrusions 12 and 13 formed at both opposite ends of the base portion 3.

The above-described structure of the rotary thread take-up lever is substantially similar to that of the conventional one. However, it should be noted that the rotary thread take-up lever 1 of the invention is designed as follows: Similarly as in the case of the conventional rotary thread take-up lever, thread holding points 14 and 15 are provided on the front and rear edges 11 and 10 of the arm 4 holding the upper thread. The thread holding points 14 and 15 hold the thread supplied maximumly. The radius of rotation R1 (which is the distance between the center of rotation O and the thread holding point 14) of the thread holding point 14 on the front edge 11 of the arm 4 is equal to that of the conventional one, whereas the radius of rotation R2 (which is the distance between the center of rotation O and the thread holding point 15) of the thread holding point 15 on the rear edge 10 of the arm is smaller than in the conventional rotary thread take-up lever. And a portion 10*b* extending from the thread holding point 15 on the rear edge 10 of the arm to the locking finger 9 is gently inclined backwardly as viewed in the direction of rotation.

Now, the operation of the rotary thread take-up lever thus constructed will be described with reference to FIGS. 1 through 5.

Figure 2:
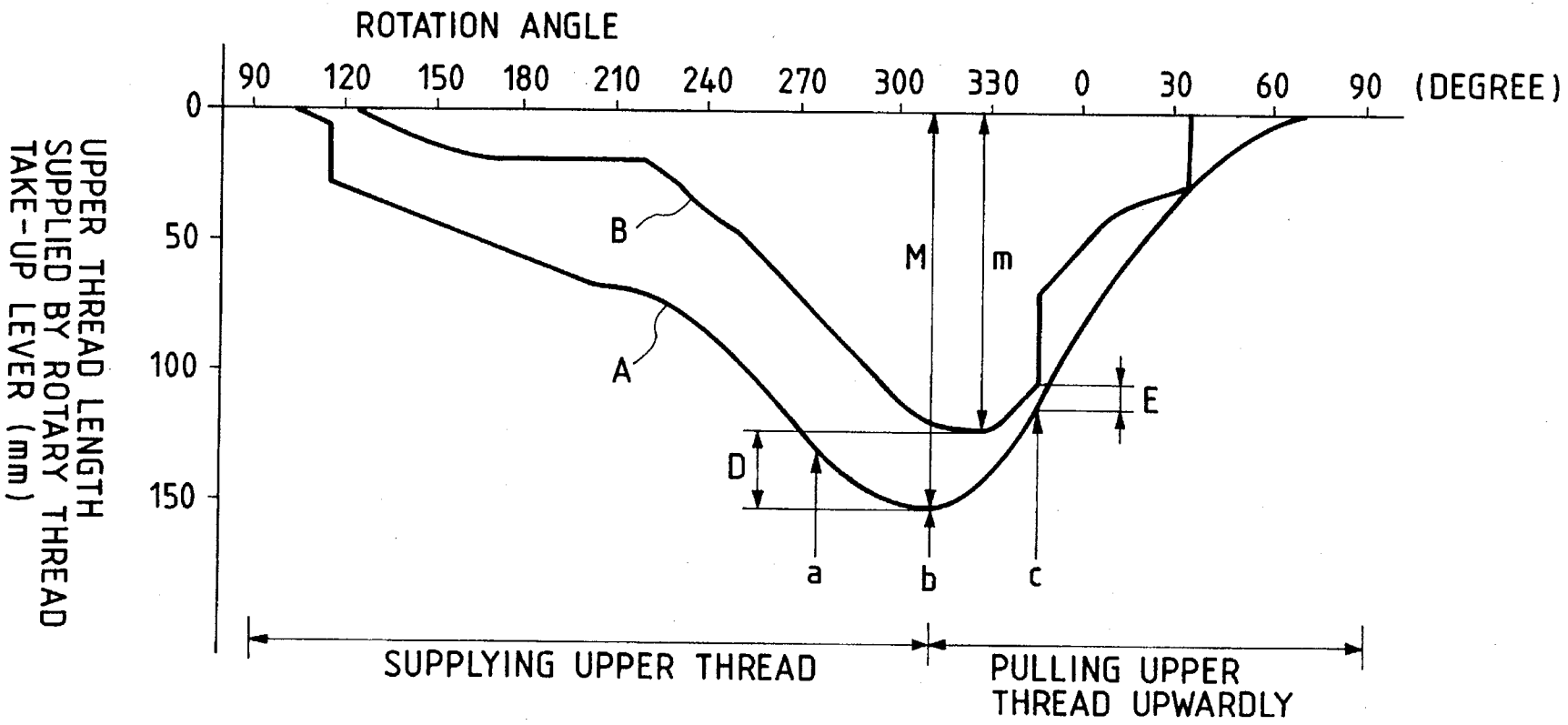
FIG. 2 is a graphical representation indicating a rotary thread take-up lever's motion curve A and a shuttle's motion curve B for an industrial zigzag sewing machine having the rotary thread take-up lever shown in FIGS. 1(*a*) and 1(*b*) and a full-turn shuttle.

FIG. 2 is a graphical representation indicating a thread take-up lever's motion curve A and a shuttle's motion curve B of an industrial zigzag sewing machine having the above-described rotary thread take-up lever 1 of the invention and a full-turn shuttle. FIGS. 3, 4 and 5 show the states of the rotary thread take-up lever and the upper thread at the time instants a, b and c in FIG. 2, respectively.

At the time instant a in FIG. 2, the upper thread is held at the thread holding point 15 on the rear edge 10 of the arm 4 as shown in FIG. 3. When, under this condition, the rotary thread take-up lever 1 is further turned, the upper thread 16 is held at the two thread holding points 14 and 15 on the front and rear edges 11 and 10 of the arm 4. At the time instant b in FIG. 2, the thread is maximumly supplied as shown in FIG. 4.

When, under this condition (shown in FIG. 4), the rotary thread take-up lever 1 is further turned, at the time instant c in FIG. 2, the upper thread is held at the thread holding point 14 on the front edge 11 of the arm 4 as shown in FIG. 5. Hence, the upper thread is pulled upwardly while being held at the thread holding point 14.

For the period of time between the time instants a and c in FIG. 2, the upper thread 16 is held by the thread holding points 14 and 15 on the rear and front edges 10 and 11. In this case, since the distance R2 (the radius of rotation of the thread holding point 15) between the center of rotation O and the thread holding point 15 on the rear edge 10 is smaller than in the conventional rotary thread take-up lever, the maximum length M of the upper thread 16 supplied by the rotary thread take-up lever 1 is smaller than by the conventional thread take-up lever, and accordingly the maximum length D of the waste thread.

The thread holding point 15 is so positioned on the rear edge 10 of the arm 4 that, when the upper thread is held at the thread holding point 14 on the front edge 11 of the arm 4 as shown in FIG. 5, the part of the upper thread which is located between the thread holding point 14 and the thread supplying source is not slackened. Hence, the length E of the waste thread which is required from the upper thread 16 to come out of the shuttle is not changed, and only the maximum length D of the waste thread is effectively decreased.

Figure 7:
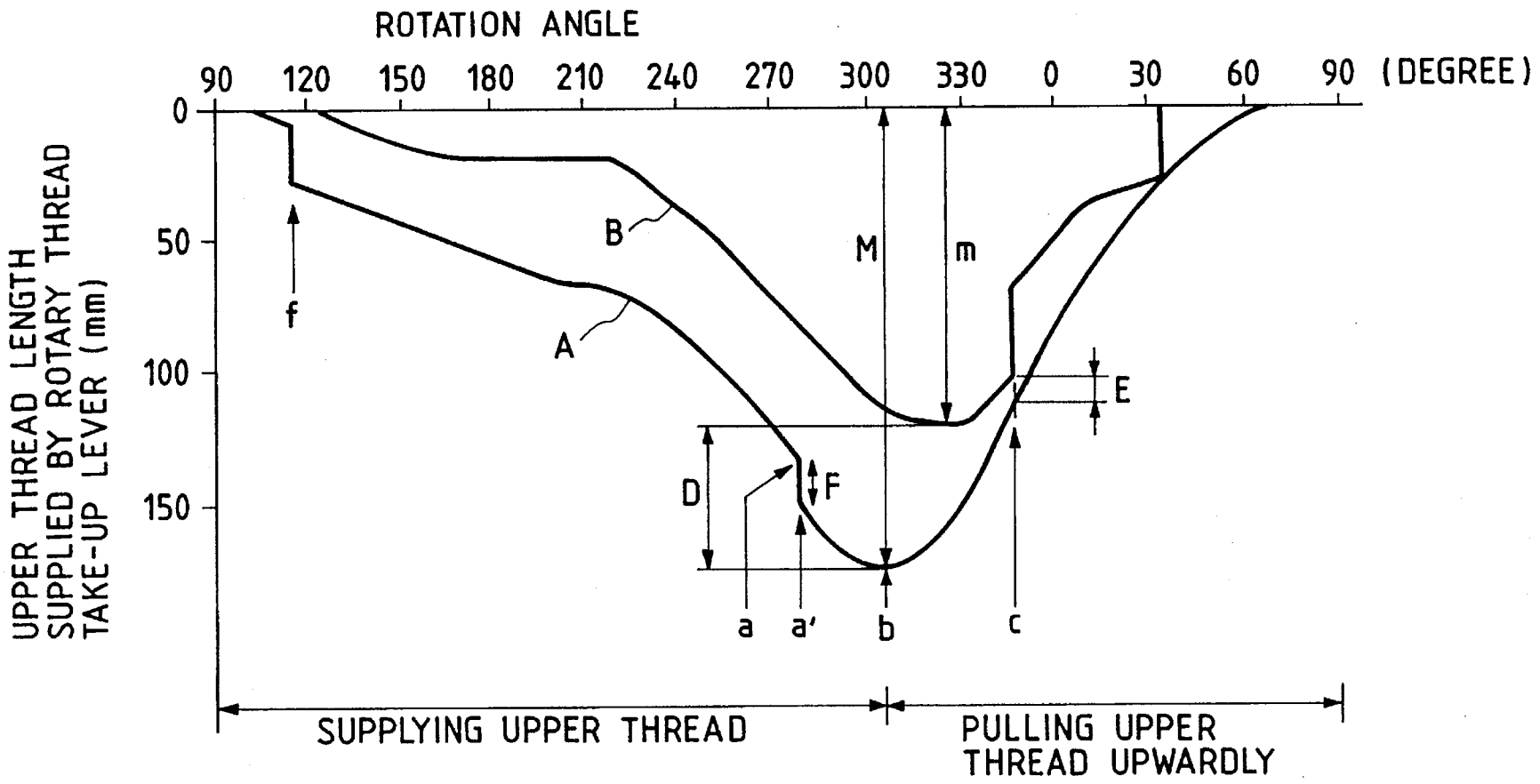
FIG. 7 PRIOR ART
FIG. 7 is a graphical representation indicating a rotary thread take-up lever's motion curve and a shuttle's motion curve for an industrial zigzag sewing machine having the conventional rotary thread take-up lever shown in FIGS. 6(*a*) and 6(*b*) and a full-turn shuttle.
Figure 8:
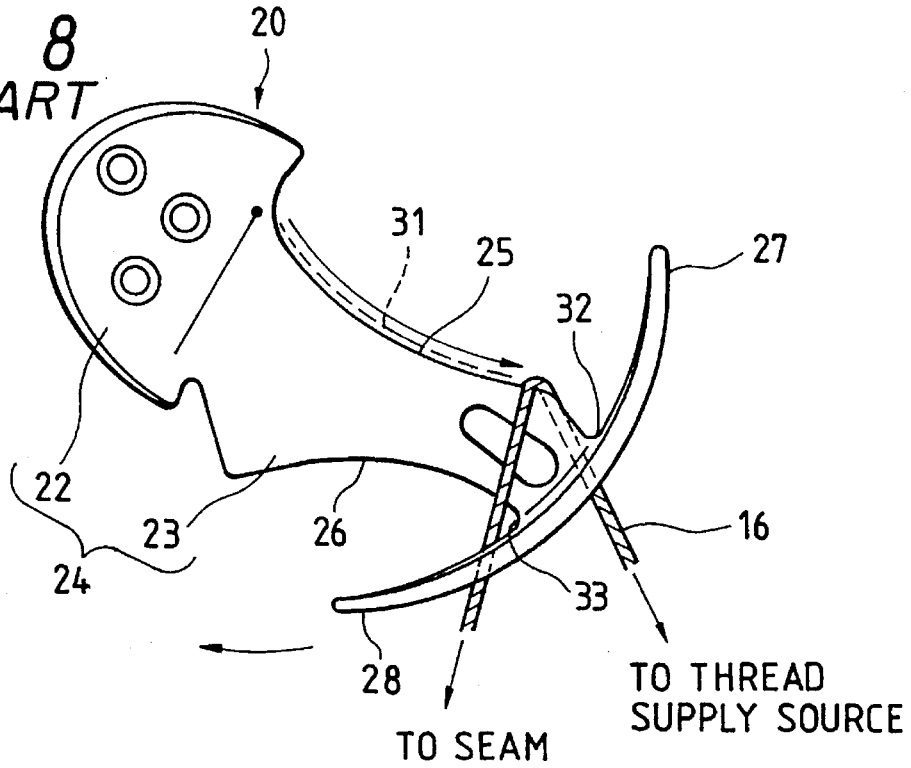
FIG. 8 PRIOR ART
FIG. 8 is a diagram showing the states of the rotary thread take-up lever and the upper thread at the time instant a in FIG. 7.
Figure 9:
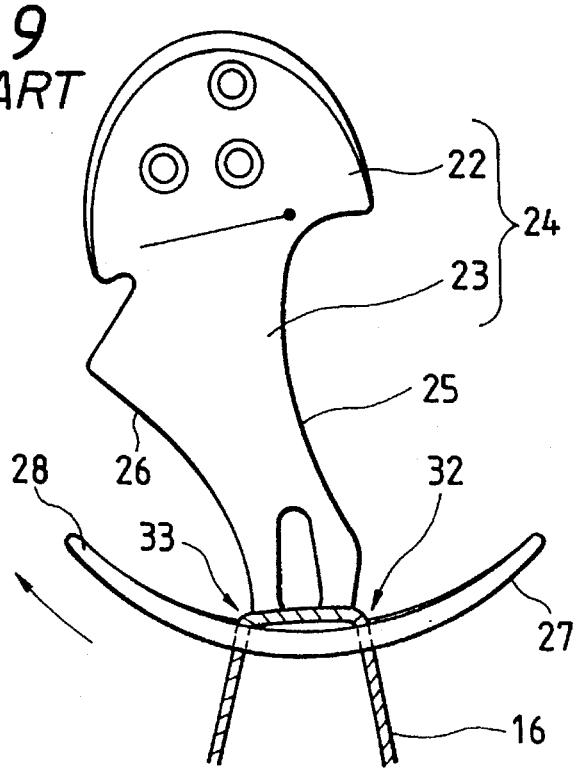
FIG. 9 PRIOR ART
FIG. 9 is a diagram showing the states of the rotary thread take-up lever and the upper thread at the time instant b in FIG. 7.

In the rotary thread take-up lever 1 of the invention, as was described before, the portion 10*b* extending from the thread holding point 15 on the rear edge 10 of the arm to the locking finger 9 is gently inclined backwardly as viewed in the direction of rotation. This feature prevents the upper thread from being released abruptly (comparing as indicated at F in FIG. 7) when the rotary thread take-up lever 1 is further turned after the time instant a in FIG. 2.

As was described above, the length of the waste thread is decreased for the period of time (between the time instants a and c in FIG. 2) that the rotary thread take-up lever holds the upper thread at two points, and furthermore the upper thread is prevented from being abruptly released. This feature substantially eliminates the difficulties accompanying the conventional thread take-up lever that, when the sewing machine is operated at high speed, the thread is liable to move unstably, and the resultant seams are irregular, and the thread may be broken.

Another embodiment will be described with referring to FIGS. 10(*a*) and 10(*b*).

During the rotary thread take-up lever 1 rotates after the upper thread is cut by a cutter of the sewing machine, it may occur that the thread thus cut is caught by the thread take-up lever and wound therearound. In this case, the tread take-up lever still pulls the thread out from the bobbin as the thread take-up lever rotates. In order to cut the upper thread thus wound around the thread take-up lever 1, the arm 4 has an elongated hole 18, and a blade is provided in the elongated hole 18. The elongated hole 18 and the blade therein are positioned outwardly with respect to the radial direction.

Figure 10A:
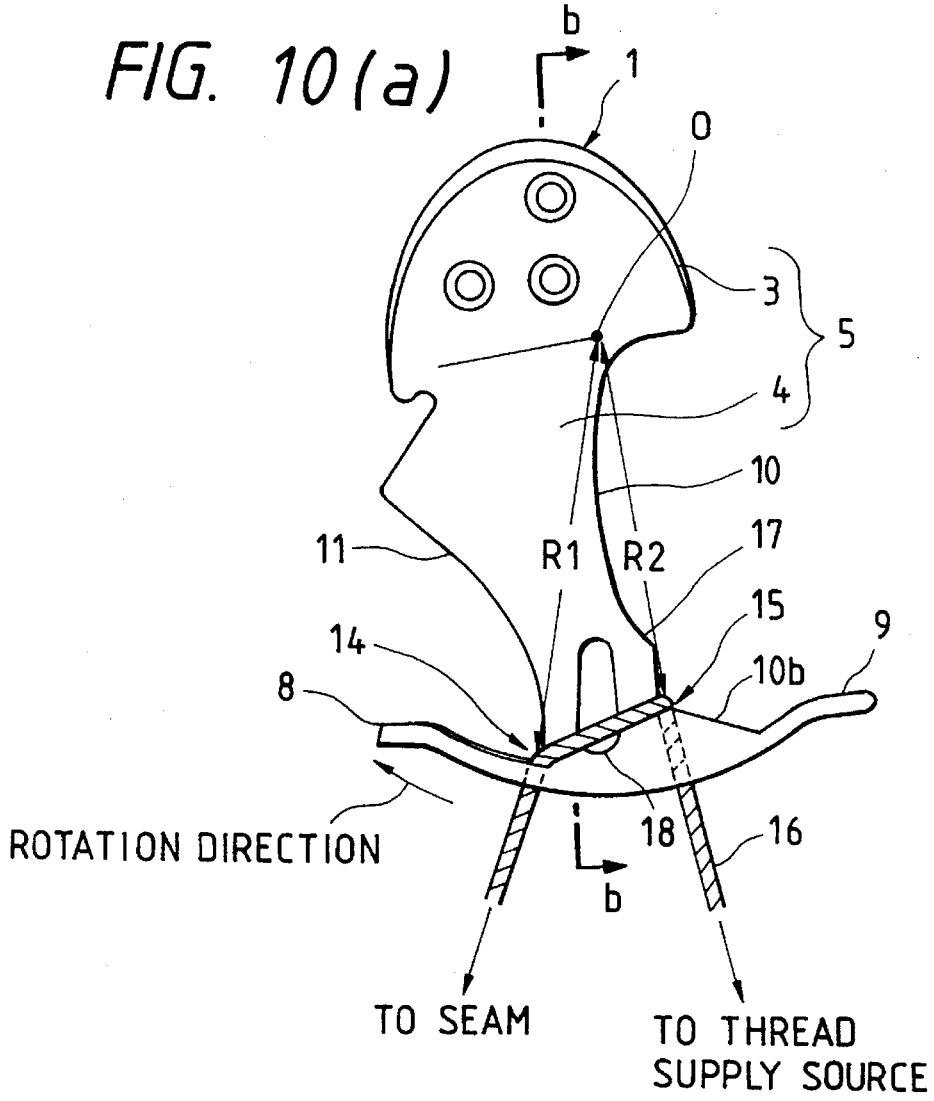
FIG. 10(*a*) is a plan view showing another rotary thread take-up lever according to the invention, and FIG. 10(*b*) is a sectional view taken along line b—b in FIG. 10(*a*).
Figure 10B:
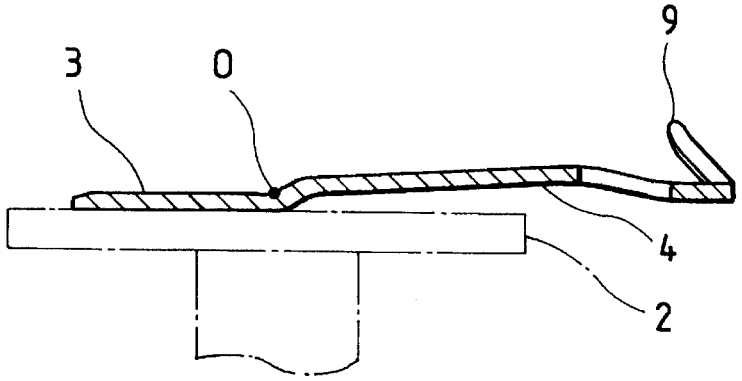

Preferably, a protrusion 17 is formed adjacent to the thread holding point 15 of the rear edge 10 inwardly with respect to the radial direction, as shown in FIG. 10(*a*). The protrusion 17 prevents the upper thread cut by the cutter from being led to the arm 4 inwardly with respect to the radial direction. Therefore, even if the upper thread thus cut winds on the arm 4 of the thread take-up lever 1, the blade surely cuts the upper thread wound thereon.

In this embodiment, the radius R2 of rotation of the thread holding point 15 on the rear edge 10 is smaller than the radius R1 of rotation of the thread holding point 14 on the front edge 11.

In this embodiment, the arm 4 is substantially shaped as a plate. That is, the outer end portion of the arm 4 does not have bending portions. Arcuate looking fingers 8 and 9 which extends forwardly and reversely from the free end of the arm 4 as viewed in the rotation direction are provided.

While the invention has been described with reference to its preferred embodiment, it should be noted that the invention is not limited thereto or thereby. For instance, the length and configuration of the arm 4, and the radii of rotation R1 and R2 of the thread holding points 14 and 15 on the front and rear edges 11 and 10, may be modified depending on the characteristic of a shuttle employed.

With the rotary thread take-up lever of the invention, the length of the waste thread which is required for the upper thread 16 to come out of the shuttle is maintained, and only the maximum length of the thread supplied by the thread take-up lever is decreased. This feature substantially eliminates the difficulties accompanying the conventional thread take-up lever that, when the sewing machine is operated at high speed, the thread is liable to move unstably, and the resultant seams are irregular, and the thread may be broken.

What is claimed is:

1. A rotary thread take-up lever for acting on an upper thread in a sewing machine, comprising:

a base portion which is continuously rotatable around a predetermined axis in one direction; and an arm extending outwardly from said base portion with respect to said axis, said arm including, a front edge facing in the direction of rotation of said thread take-up lever and having a thread holding point, wherein the upper thread being lifted by said thread take-up lever is slid on said front edge, and a rear edge facing in the direction opposite to the direction of rotation of said thread take-up lever and having a thread holding point, wherein the upper thread being supplied from said thread take-up lever is slid on said rear edge, and, when the upper thread is supplied maximumly, the upper thread is held by said thread holding points on said front and rear edges, respectively, wherein the radius of rotation of said thread holding point on said rear edge is smaller than the radius of rotation of said thread holding point on said front edge.

2. A rotary thread take-up lever according to claim 1, wherein said rear edge includes a backward portion outward from said thread holding point thereon, said backward portion being inclining backwardly as viewed in the direction of rotation of said thread take-up lever.

3. A rotary thread take-up lever according to claim 1, wherein the width of said arm outward from said thread holding point is larger than the width of said arm at said thread holding point.

* * * * *